United States Patent [19]

Tippmann

[11] Patent Number: 4,925,509

[45] Date of Patent: May 15, 1990

[54] METHOD OF MAKING A FRAMELESS REFRIGERATED STORAGE ENCLOSURE

[76] Inventor: Joseph J. Tippmann, P.O. Box 3007, Rapid City, S. Dak. 55701

[21] Appl. No.: 235,272

[22] Filed: Aug. 23, 1988

Related U.S. Application Data

[62] Division of Ser. No. 476,777, Mar. 18, 1983, abandoned.

[51] Int. Cl.[5] ..... B32B 7/00

[52] U.S. Cl. ..... 156/92; 156/182; 156/279; 156/280

[58] Field of Search ..... 156/279, 280, 92, 182; 108/51.1; 52/289, 143, 309.9; 29/458, 460, 527.1, 527.2

[56] References Cited

U.S. PATENT DOCUMENTS

| | | | |
|---|---|---|---|
| 2,494,703 | 1/1950 | Greiling | 312/253 X |
| 2,896,271 | 7/1959 | Kloote et al. | 52/309.11 |
| 3,003,810 | 10/1961 | Kloote et al. | 220/902 |
| 3,181,311 | 5/1965 | Latzer | 312/214 X |
| 3,298,883 | 1/1967 | Lemelson | 156/279 X |
| 3,393,109 | 7/1968 | Dorst | 156/279 |

FOREIGN PATENT DOCUMENTS

| | | | |
|---|---|---|---|
| 702294 | 1/1965 | Canada | 312/214 |
| 1434571 | 4/1969 | Fed. Rep. of Germany | 52/309.4 |

*Primary Examiner*—P. W. Echols
*Assistant Examiner*—I. Cuda
*Attorney, Agent, or Firm*—Joseph J. Baker

[57] ABSTRACT

A refrigerated storage enclosure has its wall, floor and roof panels made of polyurethane initially joined together by skewers. The inside surfaces of the panels are covered with a layer of fiberglass reinforced resin to permanently join the panels as is the entire outside thereby forming a monolithic structure. A door is provided in an opening in one of the walls and a skid is attached to the underside of the floor panel with fiberglass reinforced resin.

10 Claims, 3 Drawing Sheets

FIG. 1
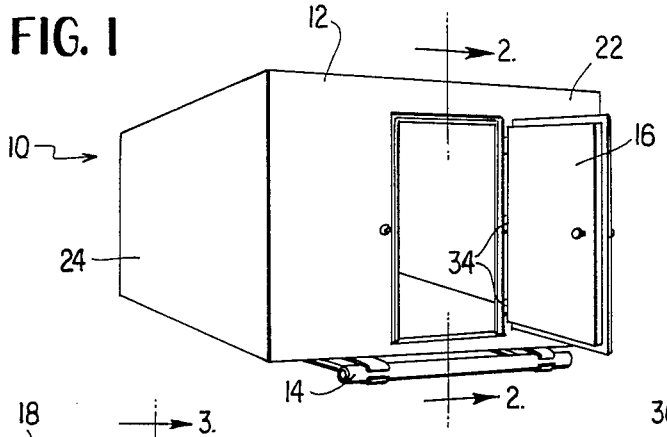
FIG. 2
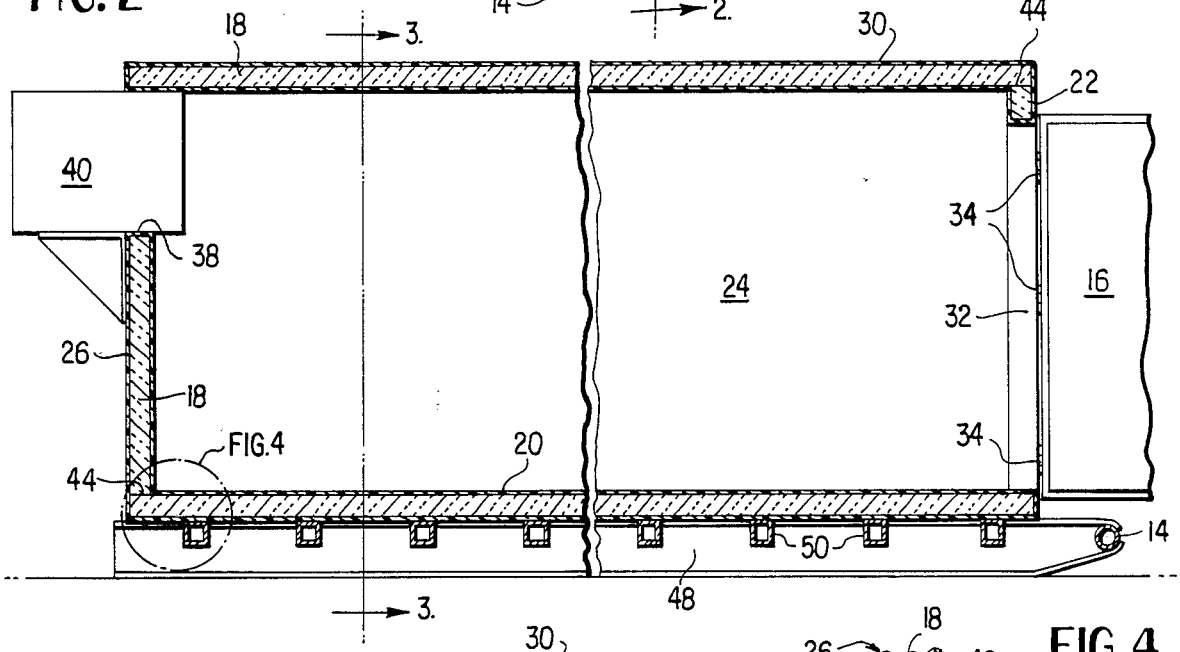
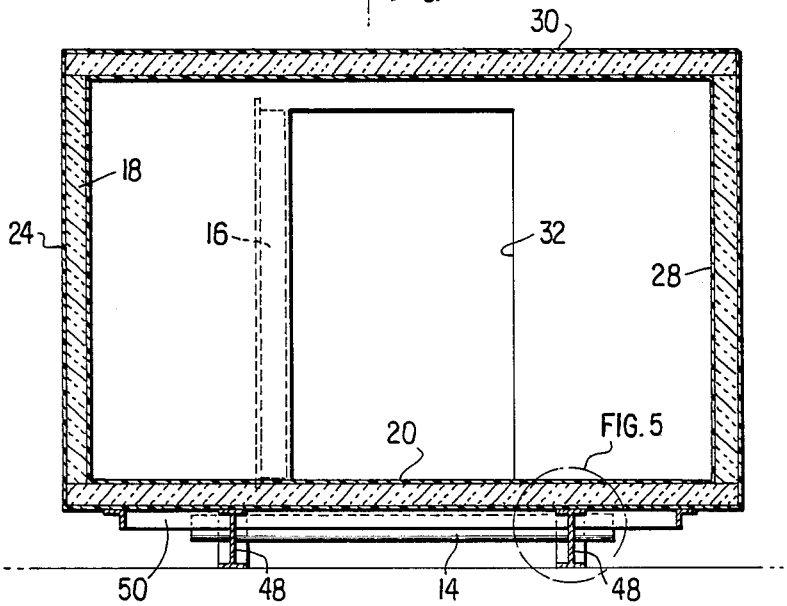
FIG. 3
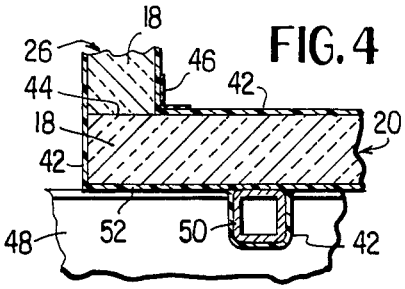
FIG. 4
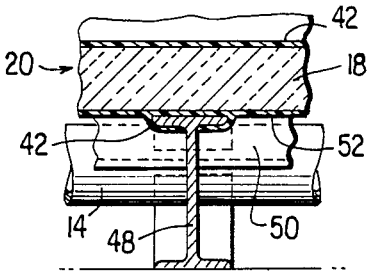
FIG. 5

METHOD OF MAKING A FRAMELESS REFRIGERATED STORAGE ENCLOSURE

This is a divisional application of Ser. No. 476,777, filed Mar. 18, 1983, now abandoned.

BACKGROUND OF THE INVENTION

This invention relates to enclosures of the refrigerated type and the method of their manufacture and more specifically to a frameless, insulated, monolithic storage enclosure with a door all made entirely of synthetic resinous material some of which is reinforced with fiberglass and mounted on a skid.

Applicant is unaware of any portable, refrigerated enclosure in the prior art structurally similar to that disclosed herein or constructed by applicant's novel method. Portable, refrigerated storage enclosures are well known in the art. They generally consist of a wooden framed structure having insulation inserted between the frame members in the form of sheet or ground cork, filamentary fiberglass or the like. The inside of the structure was typically covered with plywood panels and the outside with panels of sheet metal secured to the frame members. Condensation and the accumulation of moisture behind the metal covering soon caused the aforementioned insulating material to lose its thermal insulating characteristics. In addition, the collection of moisture in this insulating material results in rapid deterioration of the wooden framing and interior facing structure due to fungus, rot and corrosion. Further, as the thermal insulating characteristics of the insulation deteriorate, the cost of cooling the interior of the box increases which is particularly significant today due to the rising cost of electricity.

Attempts have been made to construct an enclosure of synthetic resin materials which are the subject of this invention. Such materials are both substantially nonpermeable to moisture and are non-hygroscopic. The tendency of these materials to collect moisture is negligible for all practical purposes. An example of such an attempt is disclosed in U.S. Pat. No. 3,003,810 wherein a truck body was constructed of panels of low density synthetic resin such as polystyrene which have a sublaminate of plywood secured to both sides thereof and this sublaminate is then covered by a high density resin material reinforced with fiberglass. Such a construction of synthetic materials while superior to the prior art wooden frame etc. construction aforedescribed, is entirely too complex and time consuming to construct to be economically feasible to produce on a large scale. The internal gluing and splining of the polystyrene panels together, the securement of the sublaminae to the polystyrene panels, the sealing of the joints of the sublaminae and the use of covering angles to wrap and seal the corners all greatly increase the labor and materials necessary to construct an insulated enclosure on a substantially large scale at an economical cost.

It is therefore the primary object of the present invention to provide a superior insulated storage enclosure and method of its manufacture.

It is another object of the present invention to provide a refrigerated enclosure which, due to the nature of the materials used and the unique manner of their assemblage, eliminates the complex subframe structure and the screws, bolts and other fasteners heretofore used to construct prior art structures of this nature yet achieves a structure of greater strength and durability.

It is a further object of the present invention to provide a refrigerated enclosure which, due to its simple construction, can be rapidly and cost effectively manufactured by unskilled labor employing the novel methods taught by the invention.

It is yet another object of the present invention to provide a refrigerated enclosure made entirely as a monolithic structure of, for example, a polyurethane core entirely encased in a layer of resinous material reinforced with fiberglass and having a door constructed in a similar manner.

These and other objects and purposes of this invention will be understood by those acquainted with the design and construction of refrigerated enclosures upon reading the following specification and the accompanying drawings.

BRIEF DESCRIPTION OF THE DRAWINGS

FIG. 1 is an oblique view of a refrigerated enclosure constructed according to this invention.

FIG. 2 is a side elevation view in cross-section taken along the lines 2—2 of FIG. 1.

FIG. 3 is an elevational view in cross-section taken along the lines 3—3 of FIG. 2.

FIG. 4 is an enlarged, fragmentary, sectional elevation view of the encircled portion of FIG. 2.

FIG. 5 is an enlarged, fragmentary, sectional elevation view of the encircled portion of FIG. 3.

DETAILED DESCRIPTION OF PREFERRED EMBODIMENTS

Figure 6:
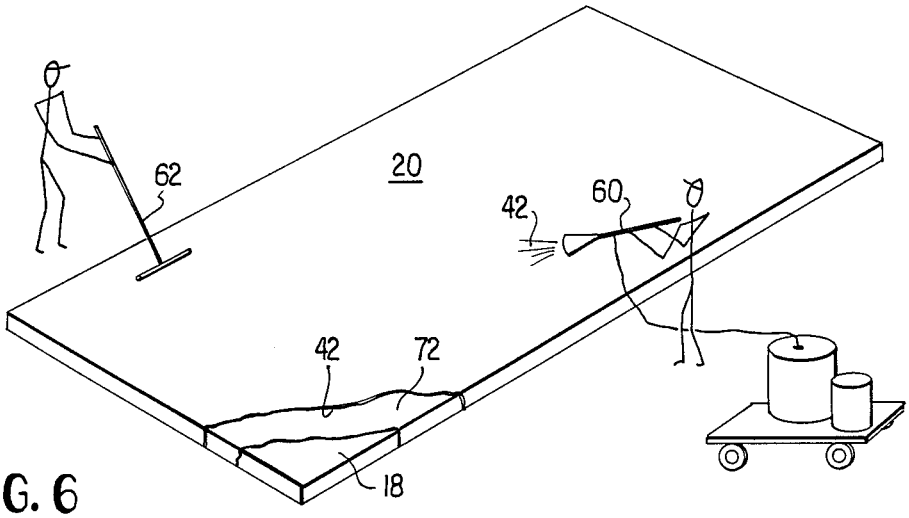
FIG. 6 is an oblique view of the floor panel of the enclosure with an area of the surface broken away

Referring now to the drawings where like characters of reference indicate like elements in each of the several figures, FIG. 1 shows generally at 10 the frameless, insulated and refrigerated storage enclosure of the present invention. The enclosure comprises the principal elements of a substantially rectangular box-shaped, monolithic shell 12 mounted on a skid 14. The shell 12 also has a freezer-type insulated door 16 mounted thereon The shell 12, as can best be seen by referring to FIGS. 2–5, has a core 18 comprising a plurality of panels or a single panel of a low density, foamed synthetic resin material such as polyurethane about 4 inches in thickness. The floor panel 20 has positioned thereon vertically upstanding wall panels 22,24,26 and 28 which are, in turn, enclosed by a roof panel 30. Typically, one of the panels such as 22 will have an opening 32 cut in it to accommodate the insulated door 16. The door 16 is pivotably attached to the panel 22 by means of hinges 34 and has a conventional latch-lock device 36. Another of the panels such as the rear panel 26 shown would typically have an opening 38 cut through it to accommodate a conventional electric refrigeration machine 40 positioned therein to cool the interior of the enclosure.

The sides of the panels 20–30 facing the interior of the shell 12 have applied thereto a continuous layer 42 of polyester resin reinforced with a fibrous material such as filamentary glass in which the filaments are arranged in the resinous material at random. Preferably, the fiberglass reinforced resinous material 42 is applied in spray form with what is commonly referred to as a "chopper gun" wherein fiberglass in the form of twine is cut into short lengths, mixed in the resin, and blown against the panel. The material 42 can be applied directly to the interior surface of the panels in their erected state or their pre-erected state as will be more fully discussed later with regard to the method of constructing the enclosure. Similarly, the sides of the panels 20–30 forming the exterior of the shell 12 have the same kind of continuous layer 42 of resinous material reinforced with fiberglass as applied to the interior surface. The resulting shell 12 comprising the core 18 entirely encased in the material 42 is extremely rigid, durable and capable of supporting great loads without the heretofore costly framing utilized in structures of this nature In addition, because all joints inside and out are completely sealed and encased in the material 42, no moisture can form in the core 18 damaging it or migrate along or through cracks at the junction 44 of the panels. To seal the junction 44 in one method of constructing the enclosure, as will be more fully discussed later, and to strengthen the corners, a strip of resinous material 46 reinforced with a woven filamentary glass web is hand applied adjacent the inside edge of the junction 44 and allowed to cure.

The skid 14 of conventional I-beam 48 and box-beam 50 construction is secured to the underside 52 of the floor panel 20. In order to eliminate the use of numerous conventional fasteners such as bolts and nuts and the like to secure the skid 14 to the underside 52 which would necessitate drilling holes through the floor panel 20 and thereby break the uninterrupted inside and outside surfaces, the skid 14 is also secured to the underside 52 by means of the fiberglass reinforced resinous material 42. As can best be seen in FIGS. 4 and 5, the material 42 encases the box-beam 50 and at least a portion of I-beam 48. This method of attaching the skid 14 eliminates the migration of moisture through any holes necessary for the use of nuts, bolts and the like with the resultant elimination of rust and corrosion of these conventional fasteners as well as the skid 14 itself.

Figure 7:
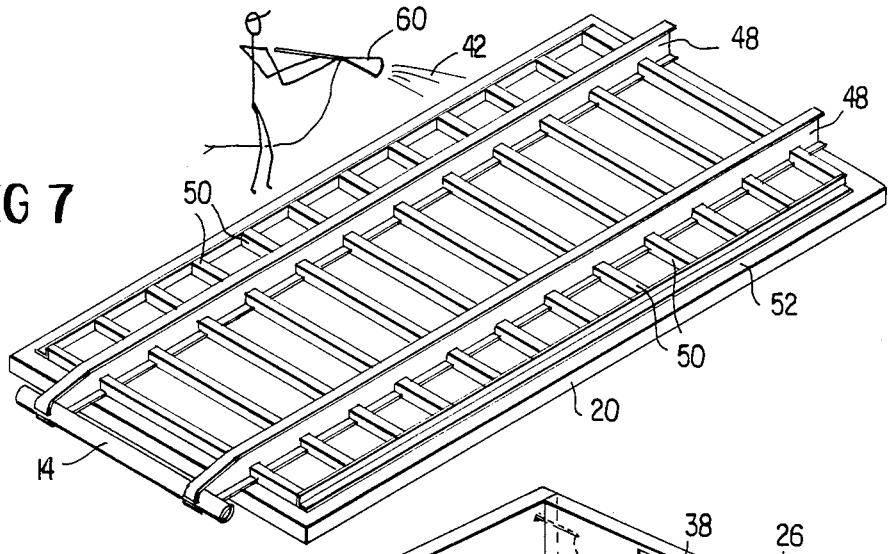
FIG. 7 is an oblique view of the skid being secured to the floor panel

Referring now to FIGS. 6–12, one method of constructing the enclosure 10 of the subject invention will be described. The first step is to position a floor panel 20 horizontally and to cover one side of the panel as shown in FIG. 6 with resinous material 42 by means of a hand held chopper-gun 60, and smoothed into a continuous layer of uniform thickness of approximately ⅛ inch by a T-shaped implement 62. This layer 42 is then permitted to cure (harden). The skid 14 is then placed on the cured surface which was previously referred to as the underside 52. The skid 14 is then secured to the underside 52 by the resinous material 42 again applied by the chopper-gun 60 as shown in FIG. 7. After this material 42 has cured, the floor panel 20 is turned over on the skid 14 and the resinous material 42 is applied to the upper surface 64 in the same manner as shown and described with regard to FIG. 6. Simultaneously, the wall panels 22,24,26 and 28 have the resinous material 42 applied to one side thereof in the manner also shown and described with regard to FIG. 6, and are permitted to cure.

Figure 8:
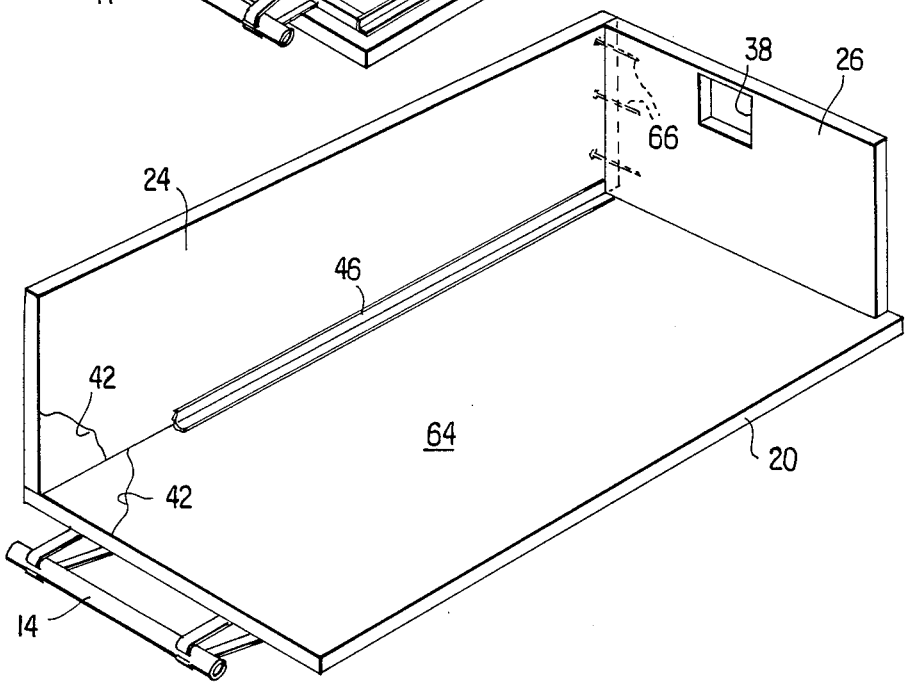
FIG. 8 is an oblique view of the erection and initial securement of two of the sides of the enclosure
Figure 9:
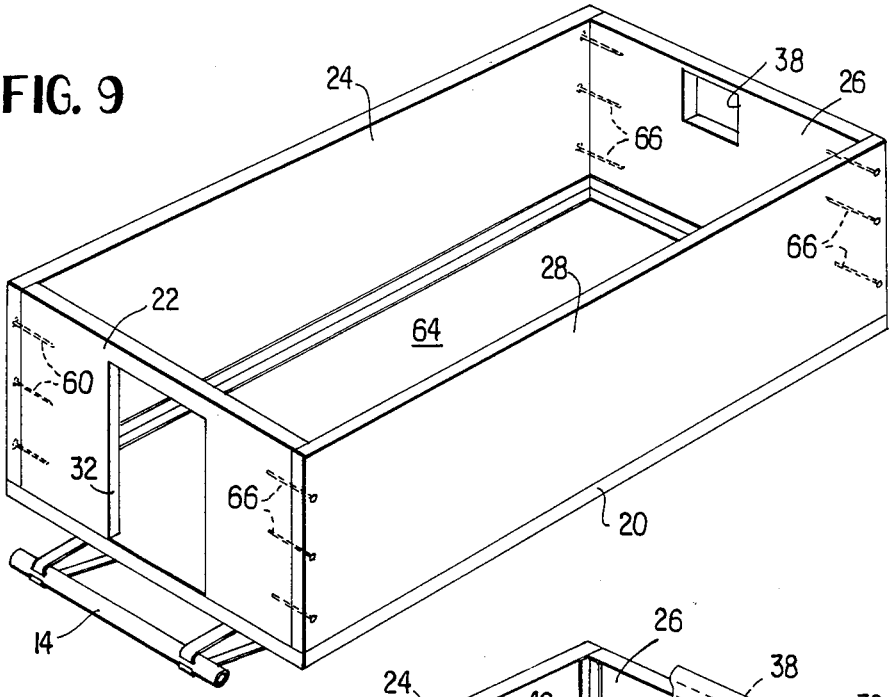
FIG. 9 is an oblique view of the erected and initially secured sides of the enclosure positioned on the floor panel.
Figure 12:
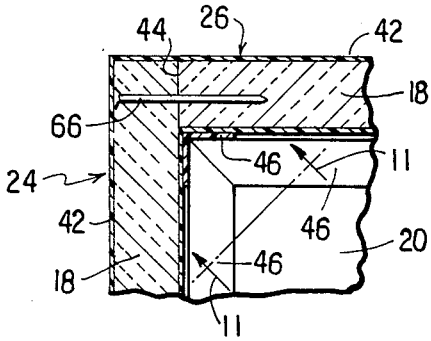
FIG. 12 is an enlarged, fragmentary, sectional view taken along the lines 12—12 of FIG. 10.

The side panels 24,26, for example, are then positioned vertically on the floor panel 20 and are maintained in this position initially simply by means of wooden skewers 66 driven through the panel 24 into the panel 26 as shown in FIG. 8 (in phantom lines) and in FIG. 12. Similarly, the side panels 22 and 28 are positioned on the floor panel 20 and joined respectively to side panels 24,26 also with skewers 66 in the aforedescribed manner as shown in FIG. 9. The interior ends 68 of the junctions 44 formed where the roof and side panels meet, where the side panels and the floor panels meet, and where the side panels themselves meet each other are then each sealed by means of the strip of resinous material 46 shown in FIGS. 8, 10 and 11. A continuous layer of resinous material 42 is then applied to the outside surface of the side panels 22,24,26,28 and the roof panel 30 and across the exterior ends 70 of the aforementioned junctions 44 sealing the junction shut. The door 16 also has a core 18 of the same material as the panels and is also totally encased in a layer of the same resinous material 42 and is then mounted in position by hinges 34 to complete the enclosure.

Figure 10:
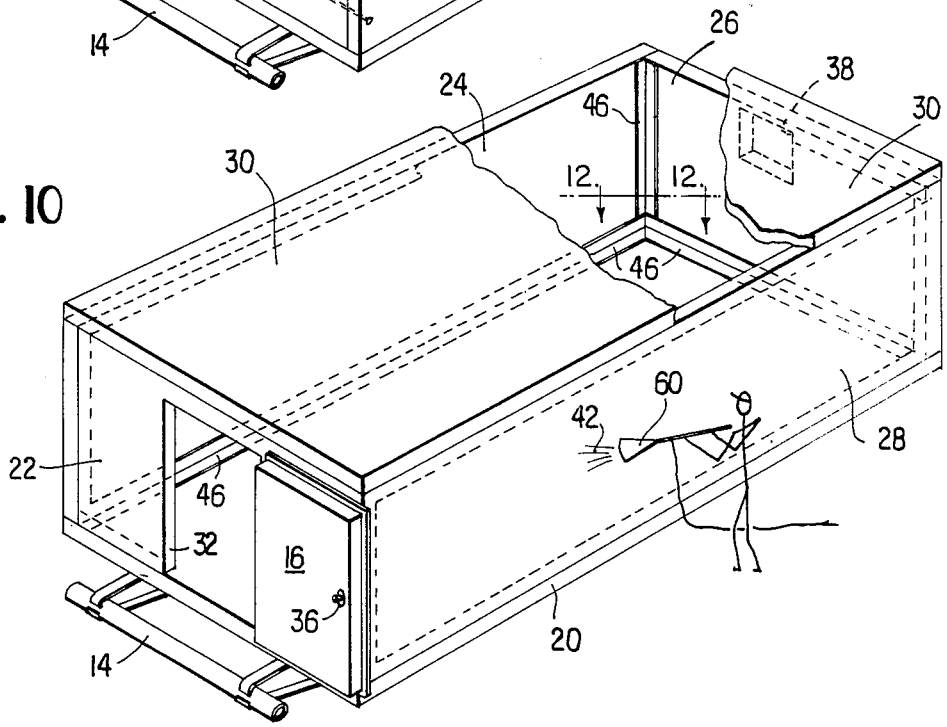
FIG. 10 is an oblique view of the nearly finished enclosure receiving the continuous outer surface of resinous material reinforced with fiberglass.
Figure 11:
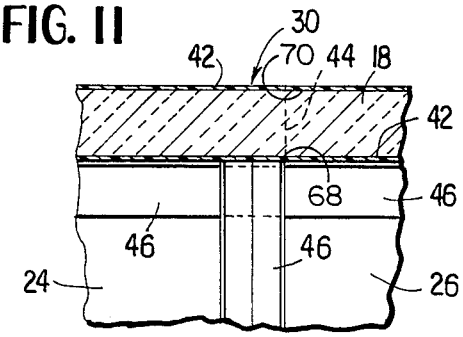
FIG. 11 is an enlarged, fragmentary, sectional plan view taken along lines 11—11 of FIG. 12.

A variation of the aforedescribed method would be to apply a layer of resinous material 42 to one side of the floor panel 20 and attach the skid 14 thereto as previously described and shown in FIGS. 6 and 7 and turn the floor panel 20 over onto the skid 14. The side panels 22,24,26,28 and roof panel 30, without the layer of resinous material 42 applied in the first method, are erected in their uncoated state as shown in FIGS. 8–10 using the skewers 66. The interior facing surfaces of the panels 20–30 and the interior ends 68 of the junctions 44 are covered with a continuous coating of resinous material 42. No resinous strip material 46 is used or is necessary as the continuous coating of resinous material 42 secures and seals the panels together. The exterior facing surfaces are then entirely covered with a continuous coating of resinous material 42 to complete the shell 12 of the enclosure and seal the exterior ends 70. The resinous material 42 would typically be applied to the panel surfaces by means of the chopper-gun 60 and implement 62. The door 16 is then attached by hinges 34 to complete the enclosure.

The polyurethane core 18 can also be provided with a thin, metallic foil or black felt-type paper impregnated with asphalt 72 covering and securing to one or both sides to prevent the penetration of ultra violet rays from the sun if the enclosure is to be used outside or a pigment can be added to the resinous material 42 to also prevent the passage therethrough of ultra violet rays which over a period of time tend to deteriorate the core 18. This foil 72 should have its surface slightly roughened by sand paper or the like to ensure adhesion of the resinous material 42.

Applicant has thus described in detail his novel refrigerated enclosure and two methods whereby it can be easily, cheaply. and very rapidly manufactured by unskilled labor for an extremely rigid, moisture proof enclosure capable of being inexpensively refrigerated when compared to the prior art refrigerated enclosures with their complex, costly frame construction and attendant poor thermal insulating characteristics.

What is claimed:

1. A method of making a frameless, insulated storage enclosure having walls, a floor, and a roof comprising the steps of:

(a) providing a plurality of panels consisting of low density synthetic resinous material, at least one of said panels having an opening therethrough, (b) applying a continuous layer of polyester resinous material reinforced with fiberglass to one side of each of said panels, (c) applying a continuous layer of polyester resinous material reinforced with fiberglass to the other side of said panel forming said floor, (d) providing skid means, (e) securing said skid means to said panel forming said floor by means of said polyester resinous material reinforced with fiberglass applied over a portion of said skid means and said layer on said panel forming said floor, (f) inverting said panel onto said skid means, (g) initially joining said other panels above said panel forming said floor to form said walls and said roof, (h) applying a layer of polyester resinous material reinforced with fiberglass across the junction of said initially joined panels to permanently join said panels and form a continuous, seamless surface defining the inside of said enclosure, and (i) applying a continuous layer of polyester resinous material reinforced with fiberglass to the other side of said panels forming said walls and said roof to join said panels and form a continuous, seamless outer surface of said enclosure.

2. A method as set forth in claim 1 wherein said panels are initially joined by means of skewers extending between said panels.

3. A method as set forth in claim 1 wherein said low density synthetic resinous material is foamed polyurethane.

4. A method as set forth in claim 3 wherein said polyurethane has a layer of metallic foil on at least one side thereof to block ultra violet rays from reaching said polyurethane.

5. A method as set forth in claim 4 wherein said polyester resinous material has pigment added thereto for preventing ultra violet rays from passing therethrough.

6. A method of making a frameless, insulated, storage enclosure having walls, a floor, and a roof comprising the steps of:

(a) providing a plurality of panels consisting of low density polyester resinous material, at least one of said panels having an opening therethrough and another of said panels forming said floor, (b) providing skid means, (c) securing said skid means to said panel forming said floor by means of polyester resinous material reinforced with fiberglass applied over a portion of said skid means, (d) rotating said floor onto said skid means, (e) initially joining said panels together on said floor panel to form said walls, floor and roof of said enclosure, (f) applying a continuous layer of polyester resinous material reinforced with fiberglass to one side of said panels to permanently join said panels and form a continuous, seamless inner surface defining the inside of said enclosure, and (g) applying a continuous layer of polyester resinous material reinforced with fiberglass to the other side of said panels to permanently join said panels and form a continuous, seamless outer surface of said enclosure.

7. A method as set forth in claim 6 wherein said panels are initially joined by means of skewers extending between said panels.

8. A method as set forth in claim 6 wherein said low density synthetic resinous material is foamed polyurethane.

9. A method as set forth in claim 8 wherein said polyurethane has a layer of metallic foil on at least one side thereof to block ultra violet rays from reaching said polyurethane.

10. A method as set forth in claim 9 wherein said polyester resinous material has pigment added thereto for preventing ultra violet rays from passing therethrough.

* * * * *

UNITED STATES PATENT AND TRADEMARK OFFICE

CERTIFICATE OF CORRECTION

PATENT NO. : 4,925,509

DATED : May 15, 1990

INVENTOR(S) : Joseph J. Tippmann

It is certified that error appears in the above-identified patent and that said Letters Patent is hereby corrected as shown below:

On title page in block [76] correct inventor's name to read "Joseph R. Tippmann".

Signed and Sealed this

Nineteenth Day of November, 1991

*Attest:*

HARRY F. MANBECK, JR.

*Attesting Officer*

*Commissioner of Patents and Trademarks*